US008860622B2

(12) United States Patent
Shin et al.

(10) Patent No.: US 8,860,622 B2
(45) Date of Patent: Oct. 14, 2014

(54) ANTENNA HAVING A CHOKE MEMBER

(75) Inventors: Phil-Soo Shin, Incheon (KR); Byung-Il Oh, Gyeonggi-Do (KR)

(73) Assignee: Ace Antenna Corporation, Incheon (KR)

( * ) Notice: Subject to any disclaimer, the term of this patent is extended or adjusted under 35 U.S.C. 154(b) by 384 days.

(21) Appl. No.: 12/681,595

(22) PCT Filed: Oct. 19, 2007

(86) PCT No.: PCT/KR2007/005139

§ 371 (c)(1), (2), (4) Date: Apr. 2, 2010

(87) PCT Pub. No.: WO2009/044954

PCT Pub. Date: Apr. 9, 2009

(65) Prior Publication Data

US 2010/0214190 A1 Aug. 26, 2010

(30) Foreign Application Priority Data

Oct. 5, 2007 (KR) ..... 10-2007-0100542

(51) Int. Cl.

| | |
|---|---|
| ***H01Q 21/00*** | (2006.01) |
| ***H01Q 1/52*** | (2006.01) |
| ***H01Q 21/26*** | (2006.01) |
| ***H01Q 21/08*** | (2006.01) |
| ***H01Q 19/10*** | (2006.01) |
| ***H01Q 19/02*** | (2006.01) |

(52) U.S. Cl.

CPC ..... *H01Q 21/26* (2013.01); *H01Q 21/08* (2013.01); *H01Q 19/106* (2013.01); *H01Q 19/021* (2013.01)

USPC ..... 343/834; 343/815; 343/846

(58) Field of Classification Search

USPC ..... 343/795, 797, 810, 834, 846, 815, 817, 343/818

See application file for complete search history.

(56) References Cited

U.S. PATENT DOCUMENTS

| | | | | |
|---|---|---|---|---|
| 5,710,569 | A * | 1/1998 | Oh et al. | 343/817 |
| 6,218,989 | B1 * | 4/2001 | Schneider et al. | 343/700 MS |
| 6,473,040 | B1 * | 10/2002 | Nakamura | 343/700 MS |
| 7,196,674 | B2 | 3/2007 | Timofeev et al. | |

FOREIGN PATENT DOCUMENTS

| | | | |
|---|---|---|---|
| JP | 19059967 | A | 3/2007 |
| KR | 2000-0007676 | A | 2/2000 |

OTHER PUBLICATIONS

Kishk, A.A., et al.; "Optimization of Microstrip Feed Geometry for Prime Focus Reflector Antennas"; IEEE Transactions on Antennas and Propagation, vol. 37, No. 4, Apr. 1989. pp. 445-451.

* cited by examiner

*Primary Examiner* — Michael C Wimer

(74) *Attorney, Agent, or Firm* — Edwards Wildman Palmer LLP; Kongsik Kim; Stephen D. LeBarron

(57) ABSTRACT

An antenna for enhancing characteristic of a beam with reducing PIMD is disclosed. The antenna includes a reflection plate, at least one first choke member disposed on one side of the reflection plate, an insulated member disposed between the reflection plate and the first choke member, thereby separating the first choke member from the reflection plate, wherein the insulated member is an insulator, and a connection member configured to connect electrically the first choke member to the reflection plate through the insulated member, wherein the connection member is a conductor.

8 Claims, 5 Drawing Sheets

ANTENNA HAVING A CHOKE MEMBER

CROSS-REFERENCES TO RELATED APPLICATIONS

This application is a U.S. national phase application, pursuant to 35 U.S.C. §371 of PCT/KR2007/005139, filed Oct. 19, 2007, designating the United States, which claims priority to Korean Application No. 10-2007-0100542, filed Oct. 5, 2007. The entire contents of the aforementioned patent applications are incorporated herein by this reference.

TECHNICAL FIELD

Example embodiment of the present invention relates to an antenna having a choke member, more particularly relates to an antenna for connecting a choke member to a reflection plate with reducing PIMD.

BACKGROUND ART

An antenna transmits/receives an electromagnetic wave by radiating a radiation pattern, and has usually structure shown in below FIG. 1.

FIG. 1 is a perspective view illustrating a common antenna.

In FIG. 1, the antenna includes a reflection plate 100 and radiation devices 102.

The reflection plate 100 has a shape bent in a specific direction as shown in FIG. 1, and includes a base member 100A and a bending member 100B.

The radiation devices 102 are disposed in sequence on the reflection plate 100.

The antenna outputs a beam in a given direction using radiation patterns radiated from the radiation devices 102.

A phase shifter (not shown) is formed on a second surface opposed to a first surface of the reflection plate 100, wherein the radiation devices 102 are disposed on the first surface. This phase shifter changes phase of an inputted signal, and transmits the changed signal to the radiation devices 102, thereby adjusting direction of the beam.

On the other hand, the beam has constant characteristics without being changed, and so a choke member (not shown) is formed on the reflection plate 100 so as to change characteristics of the beam. In this case, the choke member made up of metal is directly formed on the reflection plate 100, and so passive intermodulation distortion (hereinafter, referred to as "PIMD") is seriously occurred in the antenna.

DISCLOSURE OF INVENTION

Technical Problem

Accordingly, the present invention is provided to substantially obviate one or more problems due to limitations and disadvantages of the related art.

Example embodiment of the present invention provides an antenna for enhancing characteristic of a beam with reducing PIMD.

Technical Solution

An antenna according to one example embodiment of the present invention includes a reflection plate; at least one first choke member disposed on one side of the reflection plate; an insulated member disposed between the reflection plate and the first choke member, thereby separating the first choke member from the reflection plate, wherein the insulated member is an insulator; and a connection member configured to connect electrically the first choke member to the reflection plate through the insulated member, wherein the connection member is a conductor.

One of the first choke members is disposed on one of ends of the reflection plate in a longitudinal direction of the reflection plate, the other first choke member is disposed on the other end of the reflection plate in a longitudinal direction of the reflection plate, and the first choke members have symmetric shape.

The antenna further includes radiation devices disposed between the first choke members on the reflection plate; and at least one second choke member disposed between the radiation devices on the reflection plate.

The connection member is a bolt.

The first choke member has shape bent toward a center of the reflection plate.

The first choke member has shape bent in an outside direction of the reflection plate.

The connection member connects the first choke member to the reflection plate through the reflection plate, the insulated member and the first choke member.

The reflection plate has shape bent in a direction opposed to a direction in which the first choke member is formed.

The antenna further includes at least one radiation device disposed between the first choke members on the reflection plate; and a phase shifter disposed on one side of the reflection plate.

The antenna further includes at least one radiation device disposed on one side of the reflection plate, wherein the reflection plate has shape bent in a specific direction, the radiation devices are disposed between the bent parts of the reflection plates, and the first choke member is disposed on a given side of the reflection plate. Here, the given side opposes to a side on which the radiation devices are formed.

The antenna further includes at least one second choke member disposed between the radiation devices on the reflection plate.

The insulated member has shape bent in a specific direction, and the bent part of the insulated member supports a side of the first choke member.

An antenna according to another example embodiment of the present invention includes a reflection plate; at least one choke member disposed on one side of the reflection plate; and an insulated member disposed between the reflection plate and the choke member, thereby separating the choke member from the reflection plate, wherein the insulated member is an insulator. Here, the choke member is coupled to a ground.

Advantageous Effects

In an antenna of the present invention, a choke member is not directly contacted with a reflection plate but is indirectly connected to the reflection plate through a connection member. Accordingly, the antenna may control characteristics of a beam using the choke member, and minimize PIMD because contact area between metal members, i.e. the reflection plate, the choke member and the connection member is reduced.

BRIEF DESCRIPTION OF THE DRAWINGS

Example embodiments of the present invention will become more apparent by describing in detail example embodiments of the present invention with reference to the accompanying drawings, in which.

MODE FOR THE INVENTION

Figure 1:
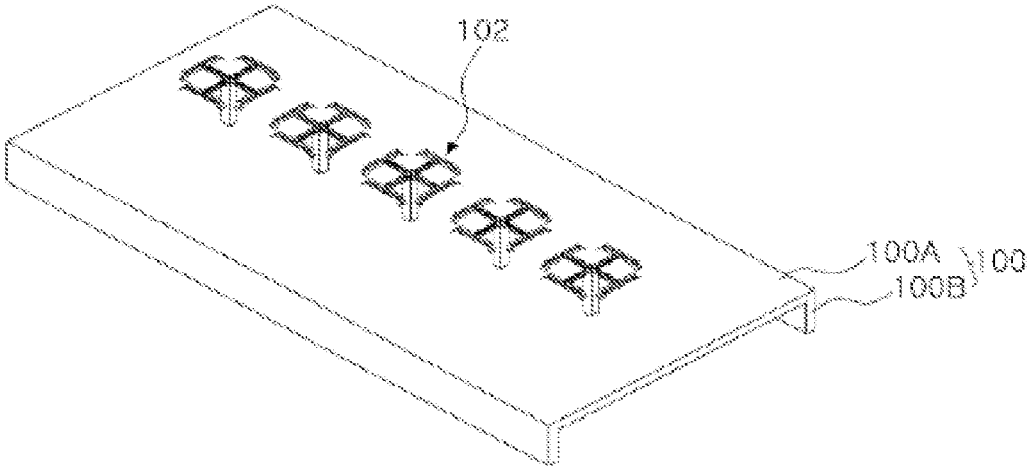
PRIOR ART Fig. 1
FIG. 1 is a perspective view illustrating a common antenna.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "connected" to another element, it can be directly connected or connected to the other element or intervening elements may be present. In contrast, when an element is referred to as being "directly connected" or "directly connected" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
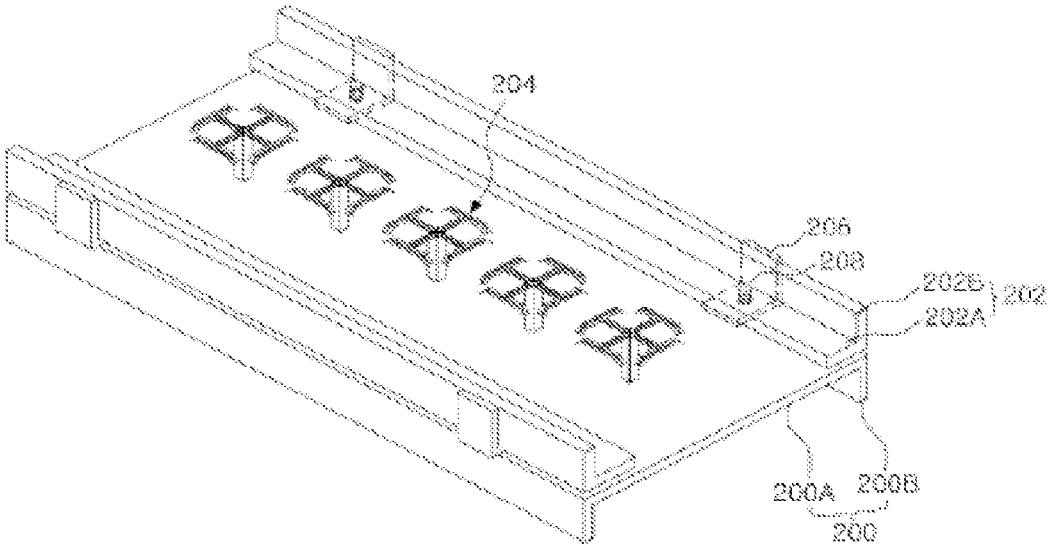
FIG. 2 is a perspective view illustrating an antenna according to a first example embodiment of the present invention.

FIG. 2 is a perspective view illustrating an antenna according to a first example embodiment of the present invention.

In FIG. 2, the antenna of the present embodiment reduces PIMD as described below, and includes a reflection plate 200 having a shape bent in a specific direction. In addition, the antenna further includes a choke member 202 disposed on the reflection plate 200, at least one radiation device 204, an insulated member 206, a connection member 208 and a phase shifter (not shown) disposed on a second surface opposed to a first surface of the reflection plate 200, wherein the radiation device 204 is formed on the first surface.

In one example embodiment of the present invention, the antenna is an array antenna where the radiation devices 204 are disposed in sequence on the reflection plate 200. Here, the radiation devices 204 are folded dipole members.

The reflection plate 200 functions as a reflector and a ground as a conductor, and has a shape bent in a specific direction as shown in FIG. 2. This reflection plate 200 includes a base member 200A and a bending member 200B bent in a specific direction from the base member 200A, e.g. formed in a direction vertical to the base member 200A.

The choke member 202 is located over the reflection plate 200 by a certain distance due to the insulated member 206 as shown in FIG. 2, and has a shape bent toward a center of the reflection plate 200. In addition, the choke member 202 includes a base member 202A and a side member 202B formed vertically from the base member 202A. In one example embodiment of the present invention, choke members 202 are disposed on both ends of the reflection plate 200 as shown in FIG. 2, respectively.

The choke member 202 controls characteristics of a beam such as width of the beam, front-to-back ratio, etc. Specially, the choke member 202 adjusts width of the beam radiated from the antenna by reflecting radiation energy radiated from the radiation devices 204. For example, the more the choke members 202 become distant from the radiation devices 204, the more the width of the beam is reduced. Additionally, the more the choke members 202 get near the radiation devices 204, the more the width of the beam is increased. Hence, a user may set location of the choke members 202 considering desired width of the beam outputted from the antenna. That is, the choke member 202 is disposed on the end of the reflection plate 200 in FIG. 2, but the choke member 202 may be located between the end and the center of the reflection plate 200.

On the other hand, the choke member 202 should be connected to a ground so as to adjust the width of the beam as mentioned above. Accordingly, the antenna of the present embodiment connects the choke member 202 to the reflection plate 200 through the connection member 208, wherein the reflection plate 200 functions as the ground. Here, contact area of the connection member 208 and the reflection plate 200 and contact area of the connection member 208 and the choke member 202 are set to have small value so as to reduce the PIMD as described below. In this case, the connection member 208 should connect stably the choke member 202 to the reflection plate 200, and thus the connection member 208 will be not embodied with too thin member.

The radiation device 204 outputs a certain radiation pattern. This will be described in detail accompanying drawing.

The insulated member 206 is an insulator, and is located between the reflection plate 200 and the choke member 202 so that the choke member 202 is separated from the reflection plate 200.

Generally, the PIMD is occurred when metals contact each other. Accordingly, the antenna of the present embodiment does not dispose directly the choke member 202 on the reflection plate 200 so as to reduce contact area. In other words, unlike an antenna in related art where a choke member is directly disposed on a reflection plate, the choke member 202 is not directly disposed on the reflection plate 200 but is electrically connected to the reflection plate 200 through the connection member 208. Particularly, the choke member 202 is contacted with the connection member 208, and the reflection plate 200 is contacted with the connection member 208.

Accordingly, contact area of metal members, i.e. the reflection plate 200, the choke member 202 and the connection member 208 in the antenna of the present embodiment is considerably reduced compared to that in the antenna in the related art. As a result, the PIMD in the antenna of the present embodiment may be considerably decreased compared to that in the antenna in the related art.

In brief, the choke member 202 is electrically connected to the reflection plate 200 which is the ground, and the PIMD may be minimized.

Now referring to the insulated member 206, the insulated member 206 may have plane shape. However, it is desirable that the insulated member has shape bent in a specific direction as shown in FIG. 2. In this case, since a bent part of the insulated member 206 supports the side member 202B of the choke member 202, the choke member 202 may be more stably set in the antenna.

The connection member 208 is a conductor, e.g. for example a bolt.

In case that the connection member 208 is the bolt, the connection member 208 is formed through the base member 200A of the reflection plate 200, the insulated member 206 and the choke member 202 from a back side of the reflection plate 200 in order to connect the choke member 202 to the reflection plate 200.

On the other hand, a method of connecting elements in the antenna may be changed as long as the connection member 208 connects the choke member 202 to the reflection plate 200. For example, the connection member 208 may be formed through only the insulated member 206 and the choke member 202 from an upper side of the reflection plate 200.

The phase shifter changes phase of signals provided to the radiation devices 204 so as to adjust direction of the beam outputted from the antenna. Here, the phase shifter may be variously changed as long as the phase shifter changes phase of the signals.

In short, in the antenna of the present embodiment, the choke member 202 is connected to the reflection plate 200 through the connection member 208 under the condition that the choke member 202 is located over the reflection plate 200. As a result, the antenna may minimize the PIMD with connecting the choke member 202 to the reflection plate 200 which is the ground.

In another example embodiment of the present invention, the choke member 208 may be connected to an extra ground member not the reflection plate 200.

In FIG. 2, the choke member 202 is disposed with one body on the reflection plate 200 in a longitudinal direction of the reflection plate 200. In another example embodiment of the present invention, a plurality of choke members may be disposed in sequence on the reflection plate 200 in a longitudinal direction of the reflection plate 200. In this case, since each of the choke members should be connected to the reflection plate 200, the antenna includes connection members as many as number of the choke members.

Hereinafter, elements in the antenna will be described in detail with reference to accompanying drawings.

Figure 3:
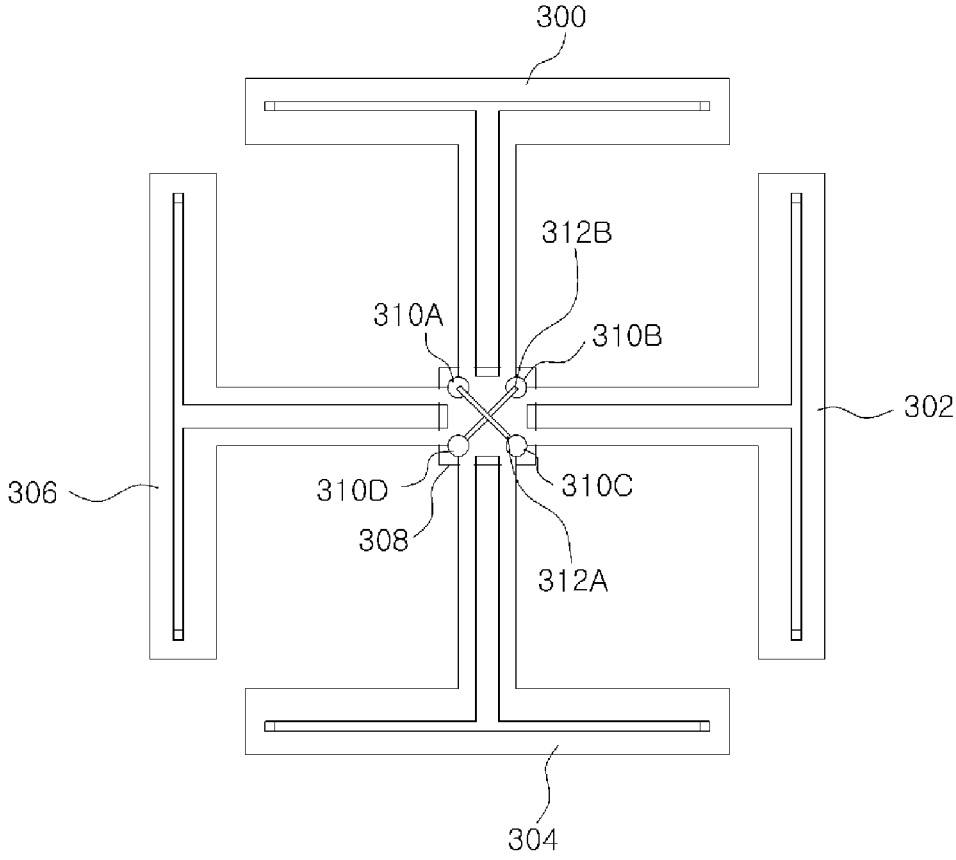
FIG. 3 is a plan view illustrating the radiation device in FIG. 1 according to one example embodiment of the present invention.

FIG. 3 is a plan view illustrating the radiation device in FIG. 1 according to one example embodiment of the present invention.

In FIG. 3, the radiation device 204 includes a first dipole member 300, a second dipole member 302, a third dipole member 304, a fourth dipole member 306 and a feeding section 308.

The feeding section 308 has a first feeding point 310A, a second feeding point 310B, a third feeding point 310C, a fourth feeding point 310D, a first connection line 312A and a second connection line 312B.

The first feeding point 310A is connected to the first dipole member 300 and the fourth dipole member 306, and provides current applied from an outside device (not shown) to the first dipole member 300 and the fourth dipole member 306.

The second feeding point 310B is connected to the first dipole member 300 and the second dipole member 302, and provides current applied from the outside device to the first dipole member 300 and the second dipole member 302.

The third feeding point 310C is connected to the second dipole member 302 and the third dipole member 304, and is connected to the first feeding point 310A through the first connection line 312A which is a conductor. Here, some of the current applied to the first feeding point 310A is provided to the third feeding point 310C through the first connection line 312A.

The fourth feeding point 310D is connected to the third dipole member 304 and the fourth dipole member 306, and is connected to the second feeding point 310B through the second connection line 312B. Here, some of the current applied to the second feeding point 310B is provided to the fourth feeding point 310D through the second connection line 312B.

In brief, the currents for the radiation pattern of the antenna are not applied to every feeding point 310A, 310B, 310C and 310D, but are applied to only two feeding points 310A and 310B. Subsequently, the applied currents are provided to the feeding points 310C and 310D from the feeding points 310A and 310B. That is, the antenna of the present embodiment uses a feeding method biased in a specific direction.

The current applied to the first feeding point 310A is provided to the first dipole member 300 and the fourth dipole member 306, and is provided to the second dipole member 302 and the third dipole member 304 through the first connection line 312A. In this case, electric fields are generated from the dipole members 300, 302, 304 and 306, and then the generated electric fields are vector-composed. As a result, +45° polarization is outputted from the radiation device 204.

The current applied to the second feeding point 310B is provided to the first dipole member 300 and the second dipole member 302, and is provided to the third dipole member 304 and the fourth dipole member 306 through the second connection line 312B. In this case, electric fields are generated from the dipole members 300, 302, 304 and 306, and then the generated electric fields are vector-composed. As a result, −45° polarization is outputted from the radiation device 204.

In other words, the radiation device 204 is a dual polarization device for generating +45° polarization and −45° polarization.

In the above description, the radiation device 204 generates the dual polarization using the vector composition method. In another example embodiment of the present invention, the radiation device 204 may generate the dual polarization using another method except the vector composition method. In addition, the radiation device 204 may use another feeding method not the feeding method biased in the specific direction.

That is, the radiation device 204 is not limited, and thus disclosed radiation device may be used as the radiation device 204 of the present invention.

Figure 4:
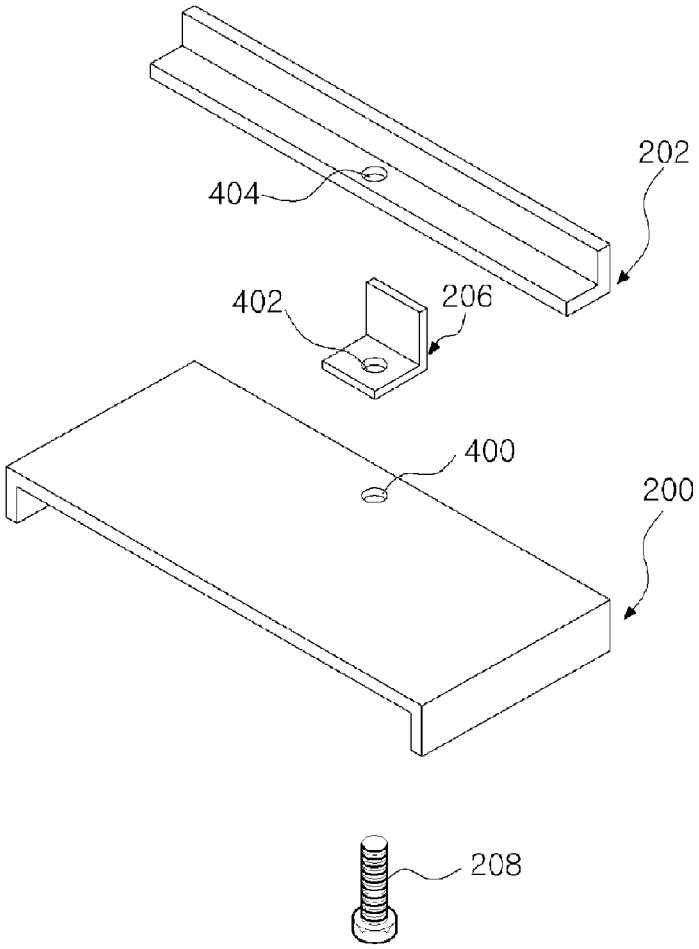
FIG. 4 is a view illustrating a process of connecting the choke member to the reflection plate according to one example embodiment of the present invention.

FIG. 4 is a view illustrating a process of connecting the choke member to the reflection plate according to one example embodiment of the present invention.

As shown in FIG. 4, the choke member 202, the insulated member 206 and the reflection plate 200 are disposed in sequence.

Holes 400, 402 and 404 are respectively formed on the reflection plate 200, the choke member 202 and the insulated member 206, wherein the connection member 208 is inserted into the holes 400, 402 and 404. Accordingly, since the connection member 208 is inserted in sequence into the holes 400, 402 and 404, the choke member 202 is connected to the reflection plate 200 through the connection member 208.

Figure 5:
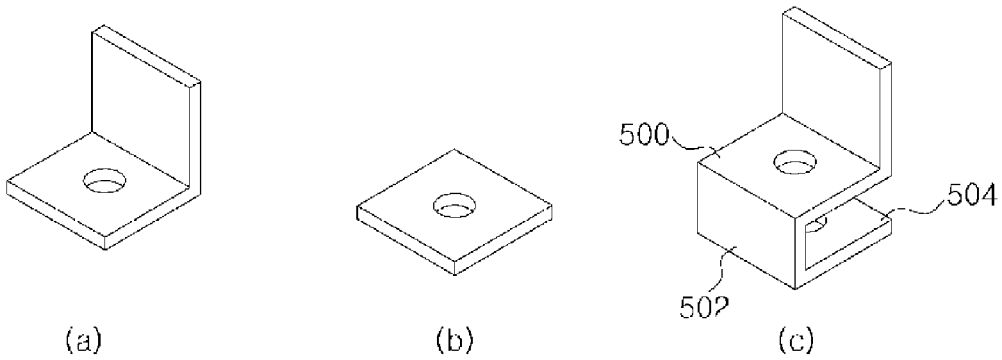
FIG. 5 is a view illustrating the insulated member according to one example embodiment of the present invention.

FIG. 5 is a view illustrating the insulated member according to one example embodiment of the present invention.

In FIG. 5(A), the insulated member 206 has shape bent in a specific direction, wherein hole is formed on the insulated member 206 so that the connection member 208 is inserted into the hole.

In FIG. 5(B), the insulated member 206 has plane shape, wherein hole is formed on the insulated member 206 so that the connection member 208 is inserted into the hole.

In FIG. 5(C), an upper part of the insulated member 206 has shape bent in a specific direction, and a lower part of the insulated member 206 has '□' shape. Particularly, the insulated member 206 includes an upper member 500, a perpendicular member 502 and a lower member 504. In this case, the perpendicular member 502 penetrates the reflection plate 200, and so the insulated member 206 is fixed to the reflection plate 200. This is not shown in FIG. 5. Additionally, the connection member 208 is connected to the choke member 202 through the lower member 504, the reflection plate 200 and the upper member 500.

In case that the insulated member 206 is fixed to the reflection plate 200 as mentioned above, the insulated member 206 and the choke member 202 may be more stably maintained on the reflection plate 200.

In short, shape of the insulated member 206 is not limited as long as the insulated member 206 separates the choke member 202 from the reflection plate 200.

Figure 6:
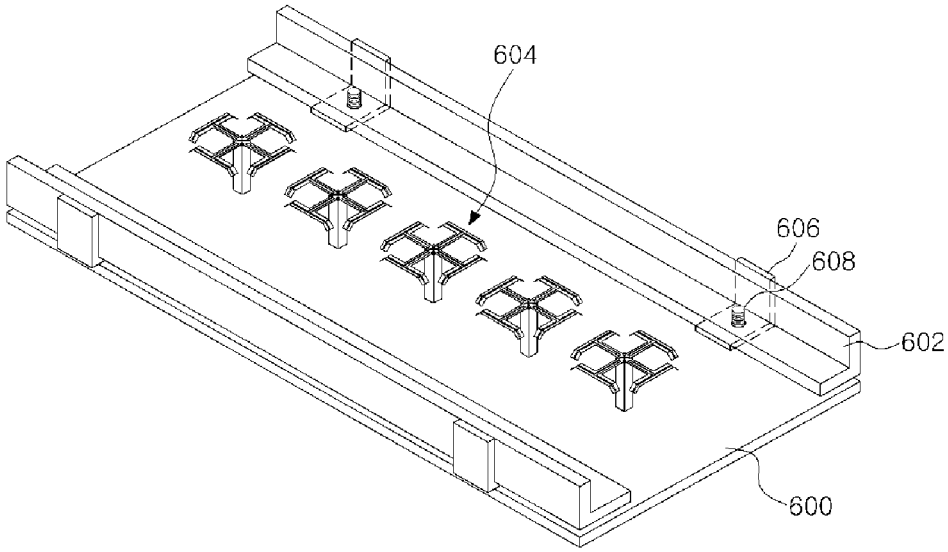
FIG. 6 is a perspective view illustrating an antenna according to a second example embodiment of the present invention.

FIG. 6 is a perspective view illustrating an antenna according to a second example embodiment of the present invention.

In FIG. 6, the antenna of the present embodiment includes a reflection plate 600, a choke member 602, at least one radiation device 604, an insulated member 606 and a connection member 608.

Since elements of the present embodiment except the reflection plate 600 are the same as in the first embodiment, any further description concerning the same elements will be omitted.

The reflection plate 600 has plane shape without being bent unlike the first embodiment.

A phase shifter (not shown) is formed on one surface of the reflection plate 600, and the choke member 602, the radiation device 604 and the insulated member 606 are formed on the other surface of the reflection plate 600.

The insulated member 606 separates the choke member 602 from the reflection plate 600.

The connection member 608 connects electrically the choke member 602 to the reflection plate 600 through the insulated member 606.

In short, the reflection plate 200 or 600 in the first embodiment and the second embodiment has shape bent in a specific direction or plane shape. On the other hand, in case that the reflection plate 200 is bent, a bent part of the reflection plate 200 reflects the radiation energy radiated from the radiation device 202. Accordingly, a user may use selectively the reflection plate 200 or 600 in accordance with desired radiation pattern.

In above description, the reflection plate 200 or 600 has shape bent in a specific direction or plane shape. However, shape of the reflection plate is not limited as the bent shape or the plane shape.

Figure 7:
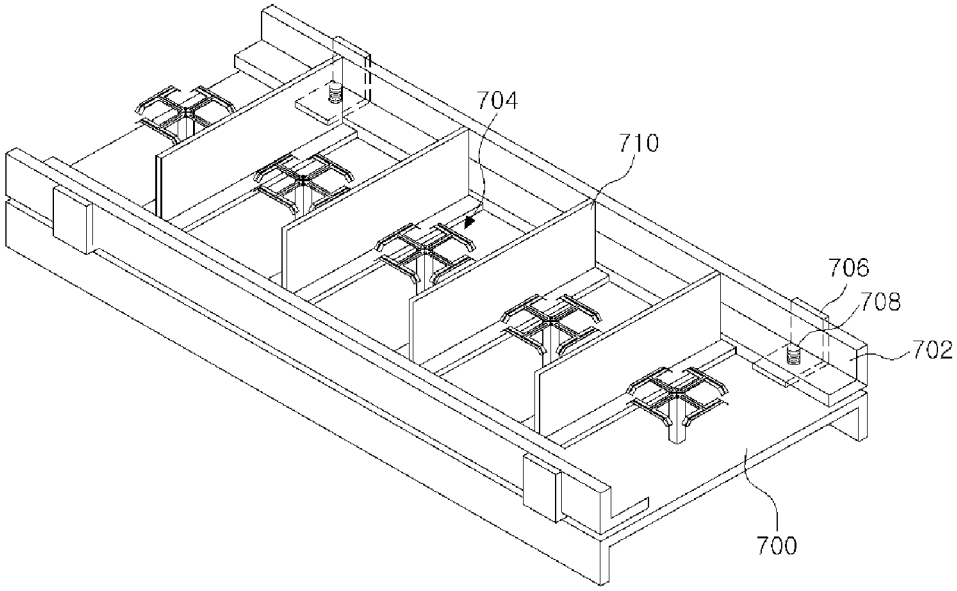
FIG. 7 is a perspective view illustrating an antenna according to a third example embodiment of the present invention.

FIG. 7 is a perspective view illustrating an antenna according to a third example embodiment of the present invention.

In FIG. 7, the antenna of the present embodiment includes a reflection plate 700, a first choke member 702, radiation devices 704, an insulated member 706, a connection member 708 and a second choke member 710.

Since elements of the present embodiment except the second choke member 710 are the same as in the first embodiment, any further description concerning the same elements will be omitted.

The second choke member 710 is disposed between the radiation devices 704, thereby separating the radiation devices 704. In addition, the second choke member 710 reflects radiation energy radiated from the radiation devices 704.

The second choke member 710 may be directly contacted with the reflection plate 700, and may be connected to the reflection plate 700 through an insulated member (not shown) like the first choke member 702.

The reflection plate 700 has shape bent in a specific direction as shown in FIG. 7 or plane shape.

Figure 8:
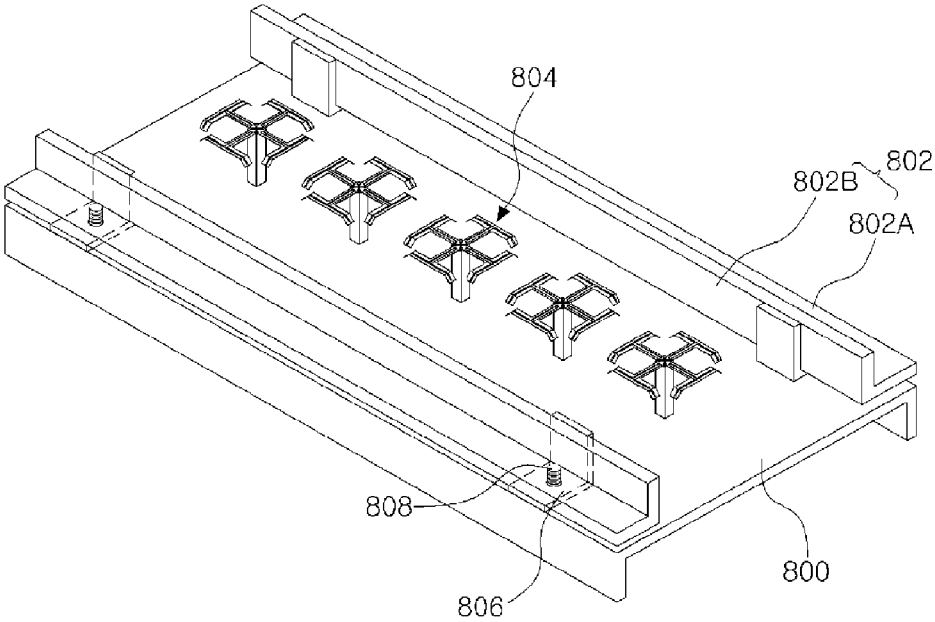
FIG. 8 is a perspective view illustrating an antenna according to a fourth example embodiment of the present invention.

FIG. 8 is a perspective view illustrating an antenna according to a fourth example embodiment of the present invention.

In FIG. 8, the antenna of the present embodiment includes a reflection plate 800, a choke member 802, a radiation device 804, an insulated member 806 and a connection member 808.

Since elements of the present embodiment except the choke member 802 are the same as in the first embodiment, any further description concerning the same elements will be omitted.

The choke member 802 has shape bent in a specific direction, and includes a base member 802A and a side member 802B. Here, each of the choke members 802 has shape bent in an outside direction of the reflection plate 800 unlike the choke member 202 in the first embodiment. In addition, the choke members 802 have symmetric shape on the basis of a center of the reflection plate 800.

The reflection plate 800 has shape bent in a specific direction as shown in FIG. 8 or plane shape.

In another example embodiment of the present invention, choke members different from the choke member 802 may be formed between the radiation devices 804.

Figure 9:
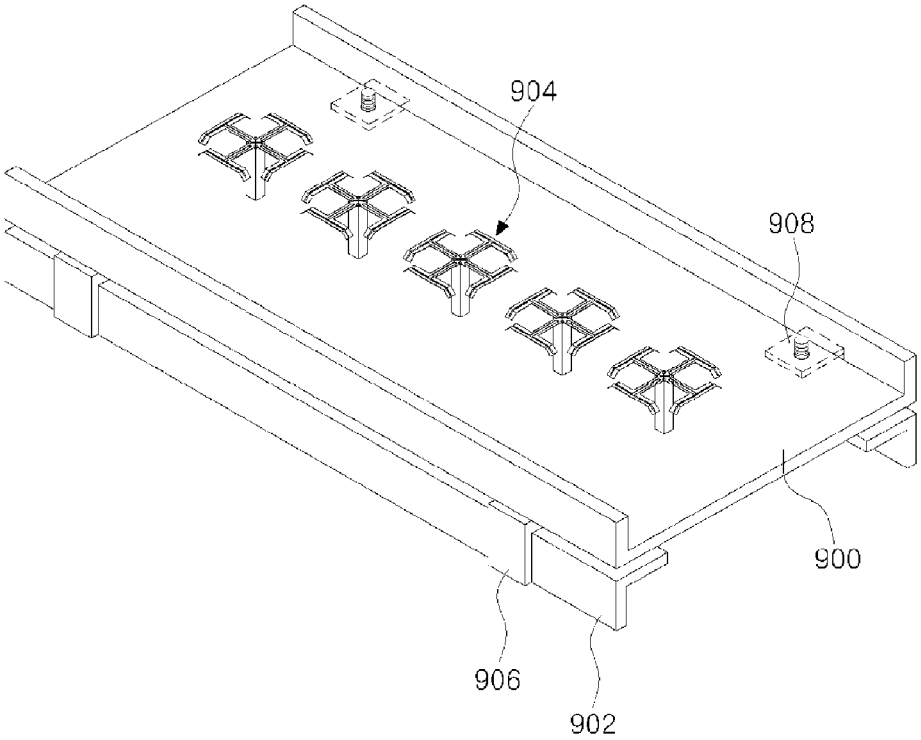
FIG. 9 is a perspective view illustrating an antenna according to a fifth example embodiment of the present invention.

FIG. 9 is a perspective view illustrating an antenna according to a fifth example embodiment of the present invention.

In FIG. 9, the antenna of the present embodiment includes a reflection plate 900, a choke member 902, at least one radiation device 904, an insulated member 906 and a connection member 908.

Since elements of the present embodiment except the reflection plate 900 and the choke member 902 are similar to that in the first embodiment, any further description concerning the similar elements will be omitted.

The reflection plate 900 of the present embodiment is bent in a direction of the radiation device 904 as shown in FIG. 9 unlike the first, second and fourth embodiments where the reflection plate is bent in a direction opposed to the direction of the radiation device.

In addition, the choke member 902 of the present embodiment is formed in the direction opposed to the direction of the radiation device 904 unlike the first to fourth embodiments where the choke member is formed in the direction of the radiation device. In this case, the connection member 908 connects the choke member 902 to the reflection plate 900 through the insulated member 906.

The choke member 902 is disposed toward a center of the reflection plate 900 as shown in FIG. 9 or is disposed toward outside of the reflection plate 900 like the fourth embodiment.

In another example embodiment of the present invention, the reflection plate 900 may have plane shape without bent.

In still another example embodiment of the present invention, another choke member not the choke member 902 is disposed between the radiation devices 904.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An antenna comprising:

a reflection plate;

at least one first choke member disposed on one side of the reflection plate;

an insulated member disposed between the reflection plate and the first choke member, thereby separating the first choke member from the reflection plate, wherein the insulated member is an insulator; and a conductive bolt connecting electrically the first choke member to the reflection plate through the insulated member, wherein holes are respectively formed in the reflection plate, the insulated member and the first choke member, and the bolt is inserted into the respective holes of the reflection plate, the insulated member and the first choke member to connect electrically the first choke member to the reflection plate, wherein the first choke member and the reflection plate are mechanically indirectly connected.

2. The antenna of claim 1, wherein one of the first choke members is disposed on one of ends of the reflection plate in a longitudinal direction of the reflection plate, the other first choke member is disposed on the other end of the reflection plate in a longitudinal direction of the reflection plate, and the first choke members have symmetric shape.

3. The antenna of claim 2, further comprising:

radiation devices disposed between the first choke members on the reflection plate; and at least one second choke member disposed between the radiation devices on the reflection plate.

4. The antenna of claim 1, wherein the reflection plate is bent in a direction opposed to a direction in which the first choke member is formed.

5. The antenna of claim 4, further comprising:

at least one radiation device disposed between the first choke members on the reflection plate; and a phase shifter disposed on one side of the reflection plate.

6. The antenna of claim 1, further comprising:

at least one radiation device disposed on one side of the reflection plate, wherein the reflection plate is bent in a specific direction, the radiation devices are disposed between the bent parts of the reflection plates, and the first choke member is disposed on a given side of the reflection plate, and wherein the given side opposes to a side on which the radiation devices are formed.

7. The antenna of claim 6, further comprising:

at least one second choke member disposed between the radiation devices on the reflection plate.

8. The antenna of claim 1, wherein the insulated member is L-shaped, and a vertical part of the L-shaped insulated member supports a side of the first choke member.

* * * * *